US010629037B2

(12) United States Patent
Anderson et al.

(10) Patent No.: US 10,629,037 B2
(45) Date of Patent: Apr. 21, 2020

(54) SMART LOCK INTRUSION DETECTION

(71) Applicant: International Business Machines Corporation, Armonk, NY (US)

(72) Inventors: Evelyn R. Anderson, Houston, TX (US); Kristen Conley, Kieler, WI (US); Martin G. Keen, Cary, NC (US); Natalie Brooks Powell, Bolingbrook, IL (US)

(73) Assignee: International Business Machines Corporation, Armonk, NY (US)

( * ) Notice: Subject to any disclaimer, the term of this patent is extended or adjusted under 35 U.S.C. 154(b) by 58 days.

(21) Appl. No.: 15/960,824

(22) Filed: Apr. 24, 2018

(65) Prior Publication Data

US 2019/0325717 A1 Oct. 24, 2019

(51) Int. Cl.

| | |
|---|---|
| ***E05B 39/00*** | (2006.01) |
| ***G08B 13/06*** | (2006.01) |
| ***E05B 65/52*** | (2006.01) |

(52) U.S. Cl.

CPC ..... *G08B 13/06* (2013.01); *E05B 39/00* (2013.01); *E05B 65/52* (2013.01); *E05Y 2900/602* (2013.01)

(58) Field of Classification Search

CPC ..... G08B 13/06; E05B 39/00; E05B 65/52; E05Y 2900/602

USPC ..... 340/542

See application file for complete search history.

(56) References Cited

U.S. PATENT DOCUMENTS

| | | | | |
|---|---|---|---|---|
| 5,531,309 | A * | 7/1996 | Kloss | G07F 17/32 194/202 |
| 8,434,577 | B1 | 5/2013 | Al-Qaffas | |
| 8,901,442 | B1 * | 12/2014 | Dilone | A45C 13/18 177/127 |
| 8,947,530 | B1 | 2/2015 | Scalisi | |
| 9,092,969 | B2 * | 7/2015 | McCown | G08B 21/00 |

(Continued)

FOREIGN PATENT DOCUMENTS

| | | |
|---|---|---|
| CN | 104957855 A | 10/2015 |
| CN | 105430767 A | 3/2016 |

(Continued)

OTHER PUBLICATIONS

PR Newswire, "eBags.com Packs in 20% More Products This Holiday," Nov. 19, 2015, pp. 1-2.

(Continued)

*Primary Examiner* — Nay Tun

(74) *Attorney, Agent, or Firm* — Jared L. Montanaro

(57) ABSTRACT

A processor may identify that a first device is in a first state. The first device may be paired with a second device that is configured to analyze one or more physical characteristics of an object. The processor may identify, using the second device, a physical characteristic of the object while the first device is in the first state. The processor may determine that the first device has transitioned to a second state. The processor may identify the physical characteristic of the object while the first device is in the second state. The processor may compare the physical characteristic of the object when the first device was in the first state to the physical characteristic of the object when the when the first device is in the second state. The processor may alert a user of the comparing.

20 Claims, 6 Drawing Sheets

(56) References Cited

U.S. PATENT DOCUMENTS

| | | | | |
|---|---|---|---|---|
| 9,443,366 | B2 | 9/2016 | Rayner | |
| 9,524,600 | B2 * | 12/2016 | Yong | E05B 65/0092 |
| 9,870,683 | B1 * | 1/2018 | Pious | G08B 13/14 |
| 9,888,756 | B2 * | 2/2018 | Shah | A45C 13/18 |
| 10,051,936 | B2 * | 8/2018 | Shah | A45C 13/18 |
| 2004/0246096 | A1 | 12/2004 | Queenan | |
| 2005/0217903 | A1 * | 10/2005 | Roberts | A45C 15/00 177/245 |
| 2006/0086541 | A1 * | 4/2006 | Khan | A45C 13/24 177/45 |
| 2006/0266563 | A1 * | 11/2006 | Kaplan | G01G 19/58 177/245 |
| 2008/0315596 | A1 * | 12/2008 | Terry | E05B 39/02 292/327 |
| 2009/0251295 | A1 * | 10/2009 | Norair | G06K 19/0716 340/10.51 |
| 2010/0033329 | A1 | 2/2010 | Davis et al. | |
| 2010/0327001 | A1 * | 12/2010 | Godlewski | A61J 7/0069 221/13 |
| 2012/0186926 | A1 * | 7/2012 | Sheikh | A45C 5/03 190/115 |
| 2013/0162429 | A1 * | 6/2013 | Pfuhl | A45C 13/18 340/539.13 |
| 2013/0169434 | A1 * | 7/2013 | McCown | G08B 21/00 340/540 |
| 2013/0175099 | A1 * | 7/2013 | Tazawa | G07G 1/0072 177/25.13 |
| 2013/0241737 | A1 | 9/2013 | Davis et al. | |
| 2014/0002239 | A1 * | 1/2014 | Rayner | G08B 13/1427 340/5.61 |
| 2014/0077952 | A1 * | 3/2014 | Boss | G06Q 10/0832 340/572.1 |
| 2014/0107868 | A1 * | 4/2014 | DiGiacomcantonio | A45C 5/14 701/2 |
| 2015/0029026 | A1 * | 1/2015 | Brandes | A45C 13/18 340/571 |
| 2015/0237980 | A1 * | 8/2015 | Shah | A45C 13/18 340/568.1 |
| 2015/0348347 | A1 * | 12/2015 | Diz | E05B 39/005 340/5.61 |
| 2016/0061647 | A1 | 3/2016 | McKinney et al. | |
| 2016/0328900 | A1 * | 11/2016 | Yong | E05B 65/0092 |
| 2016/0357384 | A1 * | 12/2016 | Khalid | H04B 5/0037 |
| 2017/0188679 | A1 * | 7/2017 | Jacob | H04W 76/10 |
| 2017/0220040 | A1 * | 8/2017 | London | G05D 1/0278 |
| 2018/0116361 | A1 * | 5/2018 | Anjum | A45C 5/14 |

FOREIGN PATENT DOCUMENTS

| | | | |
|---|---|---|---|
| CN | 205053148 | U | 3/2016 |
| CN | 105472011 | A | 4/2016 |
| WO | 2012046177 | A1 | 4/2012 |

OTHER PUBLICATIONS

PR Newswire, "Additional AT&T Foundry Innovation Center Opens in Plano," Sep. 17, 2013, pp. 1-3.

Anonymous, "A System and Method for Carry-on Luggage Based Aircraft Boarding," an IP.com Prior Art Database Technical Disclosure, IP.com No. IPCOM000243099D, Sep. 15, 2015, 12 pgs.

Anonymous, "Unique Access for Bag Event Identifiation and Analysis," an IP.com Prior Art Database Technical Disclosure, IP.com No. IPCOM000222760D, Oct. 19, 2012, 3 pgs.

Anonymous, "Method for tracking personal items," an IP.com Prior Art Database Technical Disclosure, IP.com No. IPCOM000195796D, May 17, 2010, 3 pgs.

Airbolt, "The bluetooth enabled smart lock that talks to your smartphone to unlock" https://theairbolt.com/#features, 8 pgs, printed Mar. 9, 2018.

Mell et al., "The NIST Definition of Cloud Computing," Recommendations of the National Institute of Standards and Technology, U.S. Department of Commerce, Special Publication 800-145, Sep. 2011, 7 pgs.

* cited by examiner

SMART LOCK INTRUSION DETECTION

BACKGROUND

The present disclosure relates generally to the field of chattel security, and more specifically to identifying and alerting a user to a possible intrusion of an object connected to the internet-of-things (IOT) by a smart lock.

The IOT consists of multiple devices (e.g., client devices and servers) connected via a network. The network allows the devices to intercommunicate with one another by transferring and receiving data. Even so, currently, once an object (e.g., luggage, a pallet, etc.) is tagged for a final destination, there are relatively few ways to determine if the object has been tampered with between the current location and the final destination.

SUMMARY

Embodiments of the present disclosure include a method, computer program product, and system for alerting a user to a possible intrusion of an object connected to the internet-of-things (TOT) by a smart lock. A processor may identify that a first device is in a first state. The first device may be paired with a second device that is configured to analyze one or more physical characteristics of an object. The processor may identify, using the second device, a physical characteristic of the object while the first device is in the first state. The processor may determine that the first device has transitioned to a second state. The processor may identify the physical characteristic of the object while the first device is in the second state. The processor may compare the physical characteristic of the object when the first device was in the first state to the physical characteristic of the object when the when the first device is in the second state. The processor may alert a user of the comparing.

The above summary is not intended to describe each illustrated embodiment or every implementation of the present disclosure.

BRIEF DESCRIPTION OF THE DRAWINGS

The drawings included in the present disclosure are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
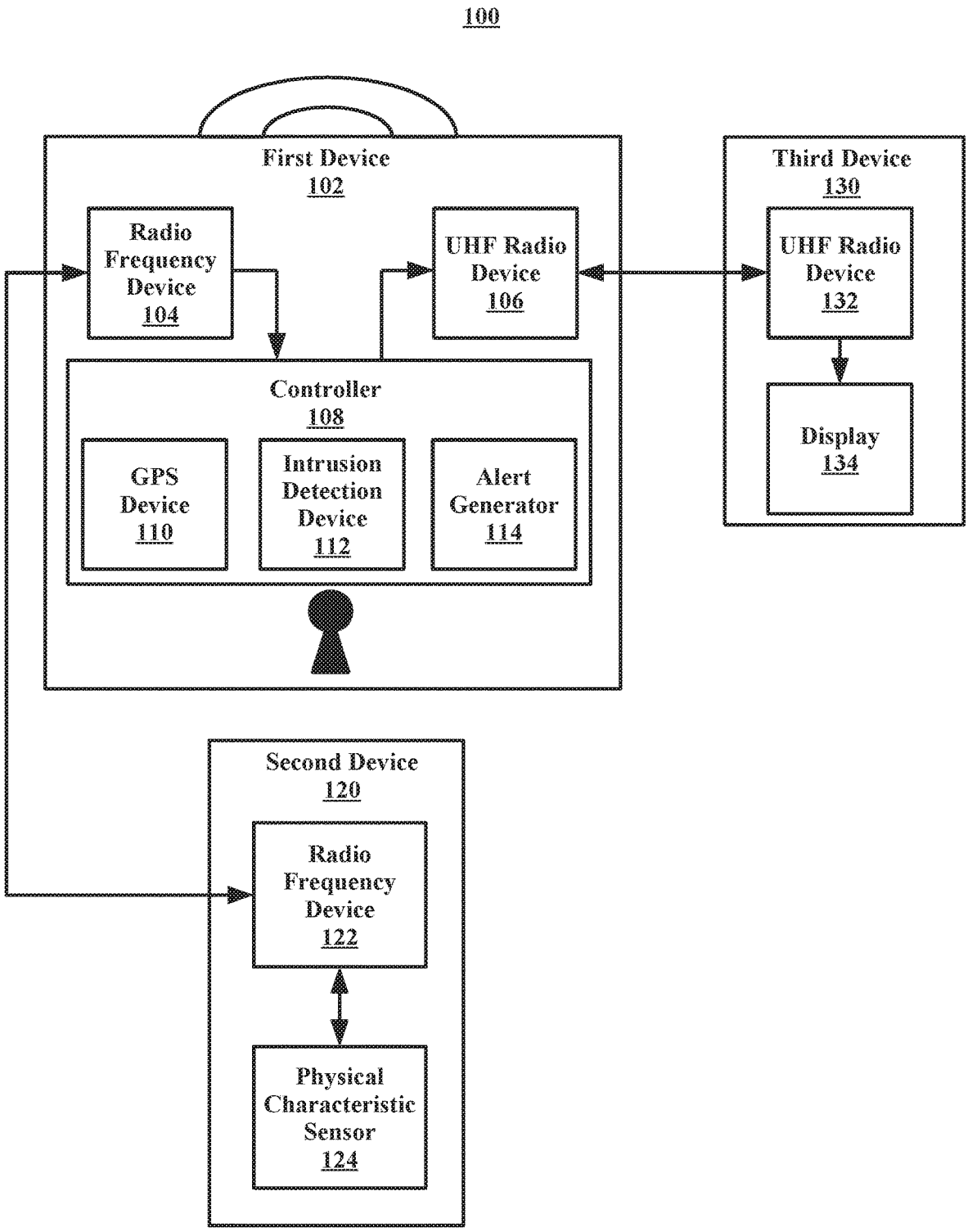
FIG. 1 illustrates a functional block diagram of an example system for alerting a user to an intrusion of an internet-of-things connected device, in accordance with embodiments of the present disclosure.

While the embodiments described herein are amenable to various modifications and alternative forms, specifics thereof have been shown by way of example in the drawings and will be described in detail. It should be understood, however, that the particular embodiments described are not to be taken in a limiting sense. On the contrary, the intention is to cover all modifications, equivalents, and alternatives falling within the spirit and scope of the disclosure.

DETAILED DESCRIPTION

Aspects of the present disclosure relate generally to the field of chattel (e.g., object) security, and more specifically to identifying and alerting a user to a possible intrusion of an object connected to the internet-of-things (IOT) by a smart lock. While the present disclosure is not necessarily limited to such applications, various aspects of the disclosure may be appreciated through a discussion of various examples using this context.

During the course of travel, an object (e.g., mail, luggage, packages, etc.) may be subject to multiple instances of non-supervision (e.g., while being transported in the hull of a plane, the back of a truck, etc.). This may lead to multiple instances of loss of the object and/or malfeasance to the contents of the object (e.g., luggage theft, mail theft, etc.). As such, a user may want to track the whereabouts (e.g., geographical location, interactions with individuals, etc.) of an object belonging to them. In order to do so, the user may turn to the internet-of-things (IOT). The user may use a smart lock that communicates with integrated sensors housed within the object and the smart lock may monitor, using the sensors, the object while it is not being supervised by the user. The smart lock may additionally alert to the user to any non-user interactions the object experiences.

In some embodiments, a processor (e.g., in a first device, in a server, in a second device, etc.) may identify that a first device (e.g., a smart lock) is in a first state (e.g., the smart lock is unlocked, locked, opened, closed, etc.). The first device may be paired with a second device (e.g., a weight sensor, a light sensor, etc.) that is configured to analyze one or more physical characteristics of an object (e.g., the weight of the object, the light intake of the object). The processor may identify, using the second device, a physical characteristic of the object while the first device is in the first state. In some embodiments, the second device may be embedded (e.g., within, a part of, etc.) the object.

For example, a luggage case may have a weight sensor integrated into the walls of the case and when the case is laid on its side/back/front/etc., in order to unzip the case, the weight sensor may monitor the weight of the contents of the case (e.g., clothes, toiletries, etc.). The weight sensor may be connected via a radio frequency (e.g., Bluetooth, RFID signal, etc.) or other communication medium to a smart lock. The smart lock may lock the luggage case by connecting zippers found on the outside of the case, and when the smart lock is put into the locked position (e.g., a first state), the smart lock may send a signal to the weight sensor to automatically identify the weight of the case.

In some embodiments, the processor may determine that the first device has transitioned to a second state. The processor may identify the physical characteristic of the object while the first device is in the second state. Following the example above, the smart lock may be unlocked (e.g., transition from a first state to a second state) by an airport employee, and the smart lock may send a signal to the weight sensor to identify the weight of the case. In some embodiments, the smart lock may wait until it is relocked (e.g., transitions back to the first state or relocking being the second state) before signaling the weight sensor to identify the weight of the case again. This may mitigate a false change in weight from being recorded and falling below a weight threshold (e.g., there is a change in weight while the employee is riffling through the case, however, after inspection and upon relocking the smart lock, there is no change in overall weight of the case).

In some embodiments, the processor may compare the physical characteristic of the object when the first device was in the first state to the physical characteristic of the object when the first device is in the second state. The processor may alert a user of the comparing. In some embodiments, the user may be alerted to the comparing only if the physical characteristic of the object when the first device is in the first state is different (e.g., not the same) as when the first device is in the second state. In some embodiments, the physical characteristic of the first device in the first state may be a threshold and if the physical state of the first device in the second state exceeds or is below the threshold, the processor may alert the user. In some embodiments, the physical characteristic of the object may be the same physical characteristic being identified (e.g., weight, light exposure, temperature, etc.).

For example, a package may be integrated with a UV-light sensor that monitors the UV-light of the inside of the package. The UV-light sensor may additionally be placed under the contents within the package in order to determine whether or not the contents have been moved while the package is open. The UV-light sensor may be paired with a smart-spider wrap lock. Upon (e.g., in response to, etc.) being locked onto the outside of the package, the smart-spider wrap lock may communicate with the UV-light sensor and record the amount of UV-light inside the package, which is 0.01 $mW/cm^2$, because the package is completely sealed, and the contents of the package block the sensor. In some embodiments, the measurement of 0.01 $mW/cm^2$ may be indicated as a threshold (e.g., baseline) limit by the processor that should not be exceeded or fallen below.

Next, upon being unlocked, the smart-spider wrap lock communicates with the UV-light sensor and monitors the amount of the UV-light inside the package. The smart-spider wrap lock may identify from the UV-light sensor that the amount of UV-light inside the package is now 0.5 $mW/cm^2$. Upon comparing the 0.01 $mW/cm^2$ of UV-light when the smart-spider wrap lock was locked to the 0.5 $mW/cm^2$ when the smart-spider wrap lock was unlocked, the smart-spider wrap lock may determine that the threshold limit of 0.01 $mW/cm^2$ has been exceeded and alert the owner of the package that the contents of the package have been moved (e.g., by identifying that the sensor is now not blocked by the contents of the package).

In some embodiments, the one or more sensors may be connected with the smart-spider wrap lock. Following the example above, in addition to the UV-light sensor, the smart-spider wrap lock may be in communication with a weight sensor housed in the package and the user may only be alerted if there is a threshold change in weight and light readings.

In some embodiments, the processor may identify the physical characteristic of the object when the first device is in the second state by triggering, in response to the first device transitioning to the second state, the second device to analyze the physical characteristic of the object. For example, a smart lock may be unlocked (e.g., transitioned from a locked state) and the smart lock may trigger a weight sensor that it is paired with to analyze (e.g., monitor, gauge, etc.) the weight within/of the object. In some embodiments, the analysis may be for a predetermined period of time and/or until the smart lock transitions back to the locked state.

In some embodiments, the processor may determine, from the comparing, that the physical characteristic of the object, when the first device was in the first state, is different than when the first device is/was in the second state. The processor may (e.g., in response to the determining) initiate an intrusion response action (e.g., activate a GPS, record a digital image taken with a camera, etc.). The intrusion response action may record environmental data associated with the object (e.g., location, time, image of surroundings, etc.) while the first device is in the second state.

For example, when a smart lock is locked, it may trigger a weight sensor to analyze the weight of the contents of a luggage case. The smart lock may identify the weight of the contents of the luggage case, using the weight sensor, to be 30 pounds (e.g., and the processor may tag the first recorded weight of the contents of the luggage as a threshold limit). Then, when the smart lock is unlocked, the smart lock may trigger the weight sensor to again analyze the weight of the contents of the luggage case. The smart lock may identify, from the retriggering of the weight sensor, the weight of the contents of the luggage case to now be 29 pounds (e.g., a second recorded weight of the contents of the luggage). Then, the smart lock may initiate an intrusion response action (e.g., a GPS device) to identify and save the location of where the luggage case is/was when the weight of the contents of the luggage case changed (e.g., when the weight of the contents of the luggage fell below the threshold limit).

In another example, the smart lock may wait until it is relocked to trigger the weight sensor to again analyze the weight of the contents of the luggage case. In response to this, the smart lock may determine that the weight of the contents of the luggage case are now 29 pounds. The smart lock may then initiate a camera to capture an image of an individual that opened and/or closed the luggage case. The smart lock may wait until being relocked to trigger the weight sensor in order to possibly forgo an unneeded intrusion response action from being initiated (e.g., if the weight of the contents of the luggage changed while opened but did not change upon being closed).

In some embodiments, the processor may identify that the physical characteristic of the object when the first device was in the first state is different than when the first device is/was in the second state by identifying that the second device transitioned from a first physical characteristic state (e.g., a first weight, a threshold limit, a determined threshold, etc.) to a second physical characteristic state (e.g., a second weight, above the threshold, below the threshold, the same as the threshold, etc.). The first physical characteristic state and the second physical characteristic state may be quantitative values associated with the physical characteristic (e.g., units of weight [pounds, kilograms, etc.], units of heat, etc.).

For example, the user may be sending an edible chocolate assortment to an individual in a package (e.g., the object). The package may include a temperature sensor on the inside of the package and locking tape around the outside edges of the package. The locking tape may include a small RFID transmitter and receiver to communicate with the temperature sensor, a small Wi-Fi transmitter to communicate with the user and individual, and a tamper sensor that, when broken, indicates that the package tape has been removed or damaged. Upon closing the package and placing the locking tape on the outside edges of the package, the temperature sensor may communicate with the RFID receiver and indicate that the inside of the package is 30-degrees Fahrenheit. The RFID transmitter may transmit the temperature to the Wi-Fi transmitter that may forward the temperature information to the user and/or the individual. This may inform the user and/or the individual that the chocolate contents of the package are still in a solid state.

Upon the package being received by the individual, the individual may cut the locking tape and the tamper sensor may communicate with the RFID receiver and trigger the RFID transmitter to initiate the temperature sensor. The temperature sensor may communicate with the RFID receiver and indicate that the temperature inside of the package, upon arrival to the individual, is now 85-degrees Fahrenheit. The RFID transmitter may transmit the temperature to the Wi-Fi transmitter that may forward the temperature information to the user and/or the individual. This may inform the user and/or the individual that the chocolate contents of the package should be put in a freezer/refrigerator before being opened because they may have melted and/or be melted.

In some embodiments, when initiating the intrusion response action, the processor may initiate, upon the first device transitioning to the second state, a timer set with a predetermined time. The processor may identify that the first device has not transitioned back to the first state within the predetermined time. For example, a smart lock may be preprogramed to take a snapshot of the time and location that a luggage case is open if the case is open for more than 1 minute (e.g., the average time of an airport employee search).

In some embodiments, the processor may identify that the first device is within a predetermined range (e.g., a communicative range or physical distance) of a third device. The third device may be associated with the user. The first device may be paired (e.g., via Bluetooth, Wi-Fi, etc.) with the third device. The processor may prevent the user from receiving the notification if the first device is within the predetermined distance from the third device, which may include disabling the first device and the second device.

For example, a smart lock may be paired with a user's smartphone. The smart lock and the smartphone may communicate via Bluetooth and, while the smart lock and the smartphone are within Bluetooth range, the smart phone may turn all features of the smart lock (e.g., RFID pairing with a sensor, intrusion response actions, etc.) besides the Bluetooth functionality off, which, in turn, or simultaneously, may turn off a sensor additionally connected to the smart lock (e.g., a geo-fence surrounding the user/user's smartphone may be generated). The turning off of the smart lock and sensor may save battery life and/or hardware incorporated in the smart lock and sensor.

In some embodiments, the processor may identify that the first device is outside of the predetermined range of the third device. The processor may re-enable the first device and the second device in response to identifying that the first device is outside of the predetermined range of the third device. The first device may be re-enabled via a first indication triggered by the third device. The second device may be re-enabled via a second indication received from the first device.

Following the example above, the user may walk outside of Bluetooth range with their smartphone. The smart lock may identify that the smartphone is no longer communicating with the smart lock, triggering the smart lock to activate all features currently turned off (e.g., RFID pairing with a sensor, intrusion response actions, etc.). When the smart lock is triggered to activate all features currently turned off, the smart lock may simultaneously send an indication (e.g., via an RFID transmitter) to a light sensor located within a brief case that may now monitor the light intensity within the brief case (e.g., in order to identify if the brief case's contents have been rearranged/moved by noting paper contents partially blocking the light sensor, etc.).

Referring now to FIG. 1, illustrated is a functional block diagram of an example system 100 for alerting a user to an intrusion of an IOT connected device, in accordance with embodiments of the present disclosure. In some embodiments, the system 100 includes a first device 102, a second device 120, and a third device 130. In some embodiments, each of the devices 102, 120, and 130 is connected to the IOT via the Internet and communicates with one another via the IOT. In some embodiments, the devices 102, 120, and 130 are connected to the IOT and/or communicate with one another via a wireless network or a wired network (e.g., Bluetooth, radio signals, etc.). In some embodiments, the devices 102, 120, and 130 may be connected to and communicate with one another via a cloud computing infrastructure.

In some embodiments, the first device 102 includes a radio frequency device 104, an ultra-high frequency (UHF) radio device 106 (e.g., Wi-Fi, Bluetooth, GPS, etc.), and a controller 108. In some embodiments, the controller 108 includes a GPS device 110 (e.g., which may be a part of the UHF radio device 106), an intrusion detection device 112 (e.g., a camera, an alarm, etc.), and an alert generator 114. In some embodiments, the second device 120 includes a radio frequency device 122 and a physical characteristic sensor 124. In some embodiments, the third device 130 includes a UHF radio device 132 and a display 134.

In some embodiments, the physical characteristic sensor 124 communicates recorded information of an object (not shown in the system 100) associated with the second device to the radio frequency device 122. For example, a weight sensor incorporated into a pallet may monitor the weight of the pallet and communicate the information to an RFID transmitter additionally incorporated in the pallet. In some embodiments, the physical characteristic sensor 124 may be triggered to record the information associated with the object upon the radio frequency device 104 communicating with the radio frequency device 122 that the first device has entered a first state (e.g., lock, unlocked, opened, closed, etc.).

In some embodiments, the radio frequency device 122 communicates with the radio frequency device 104 and forwards the recorded information of the object to the first device 102 via the radio frequency device 104. The radio frequency device 104 then forwards the recorded information of the object to the controller 108, which processes the information to determine if the GPS device 110, intrusion detection device 112, and/or the alert generator 114 should be activated. In some embodiments, the controller includes a memory that stores the information associated with the object until subsequent information is received for the controller to compare the stored information against the subsequently received information.

In some embodiments, the controller receives subsequent information associated with the object when the first device has transitioned to a second state. Following the example above, the controller 108 may determine that the weight of the pallet was 100 pounds when a lock was first locked and 110 pounds when the lock was unlocked and then relocked.

The controller 108 may then activate the GPS device 110, the intrusion detection device 112, and the alert generator 114.

In some embodiments, the controller 108, if it determines to activate the GPS device 110, the intrusion detection device 112, and the alert generator 114, communicates with the UHF radio device 106. The controller 108 forwards the GPS device 110 information, the intrusion detection device 112 information, and the alert generator 114 information to the UHF radio device 106, which forwards information to the UHF radio device 132. The UHF radio device 132 then displays the information on the display 134.

Again, following the example above, upon determining that the weight of the pallet has changed, the controller 108 snapshots the location of where the pallet changed weight and uses a camera to take a picture of the environmental surrounds the pallet was in when it changed weight. The controller 108 then generates an alert with the location and picture and transmits the information to a user's smartphone.

It is noted that any number of devices (e.g., thermometer, light sensor, weight sensor, etc.) could be connected to the first device and all connected devices might be activated when a state change is identified. For example, a thermometer and a hygrometer may be inside a package and connected via Bluetooth to a smart lock that is locked on the outside of the package. When locked, the sensors may identify the inside temperature of the closed package as 75-degrees Fahrenheit and the humidity at 50%. The smart lock may then be unlocked, and it may initiate the thermometer and the hygrometer to read the temperature and humidity of the package. The thermometer may now read the inside temperature of the package as 77-degrees and the humidity at 70% (e.g., indicating that the package has been opened and exposed to the outside environment). The smart lock may then alert the user to the physical changes identified in regard to the package.

Figure 2:
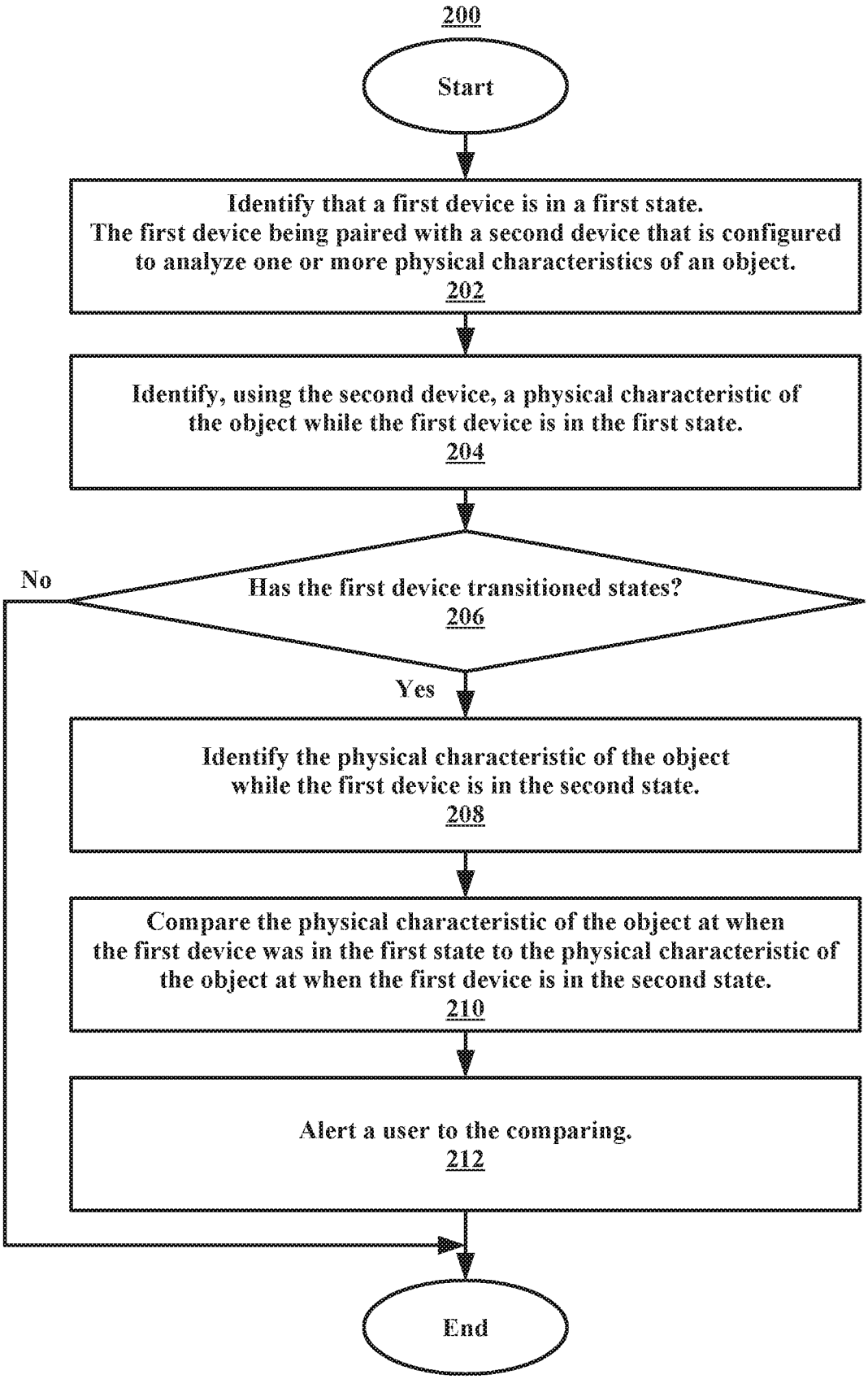
FIG. 2 illustrates a flowchart depicting an example method for alerting a user to a physical characteristic comparison of an internet-of-things connected device, in accordance with embodiments of the present disclosure.

Referring now to FIG. 2, illustrated is a flowchart depicting an example method 200 for alerting a user to a physical characteristic comparing of an IOT connected device, in accordance with embodiments of the present disclosure. In some embodiments the method 200 may be performed by a first device (e.g., or a second device, or a third device, etc.). In some embodiments, the method 200 may be performed by a processor (e.g., in a first device, in a second device, etc.).

In some embodiments, the method 200 begins at operation 202. At operation 202, the processor identifies that a first device is in a first state. The first device is paired with a second device that is configured to analyze one or more physical characteristics of an object. In some embodiments, after operation 202, the method 200 proceeds to operation 204. At operation 204, the processor identifies, using the second device, a physical characteristic of the object while the first device is in the first state.

In some embodiments, after operation 204, the method 200 proceeds to decision block 206. At decision block 206, it is determined if the first device has transitioned to a second state. If, at decision block 206, it is determined that the first device has not transitioned states (e.g., locked to unlocked, etc.), the method 200 will end. If, at decision block 206, it is determined that the first device has transitioned states, the method 200 will proceed to operation 208.

At operation 208, the processor identifies the physical characteristic of the object while the first device is in the second state. In some embodiments, after operation 208, the method 200 proceeds to operation 210. At operation 210, the processor compares the physical characteristic of the object when the first device was in the first state to the physical characteristic of the object when the first device is in the second state. In some embodiments, the physical characteristics of the object may be identified from multiple sensors.

For example, two weight sensors may be associated with the same object and each sensor may identify the weight of the object in response to a first device transiting states. In some embodiments, the two weights recorded from each sensor may be averaged in order to determine a threshold (e.g., baseline) weight of the object, when the first device is in a first state. Additionally, when the first device transitions to a second state, the two weights from each sensor may average again in order to compare the threshold weight to the (new) weight now found. This may allow the first device to gauge a more accurate reading of object and prevent false alerts from being sent to a user and/or it may allow the first device to continue working in the event that one sensor malfunctions.

In some embodiments, after operation 210, the method 210 proceeds to operation 212. At operation 212, the processor alerts a user to the comparing. In some embodiments, the processor may only alert the user to the comparing if the physical characteristic of the object when the first device was in the first state is not the same as when the first device is in the second state (e.g., physical characteristic of the object has changed). After operation 212, the method 200 ends.

Figure 3:
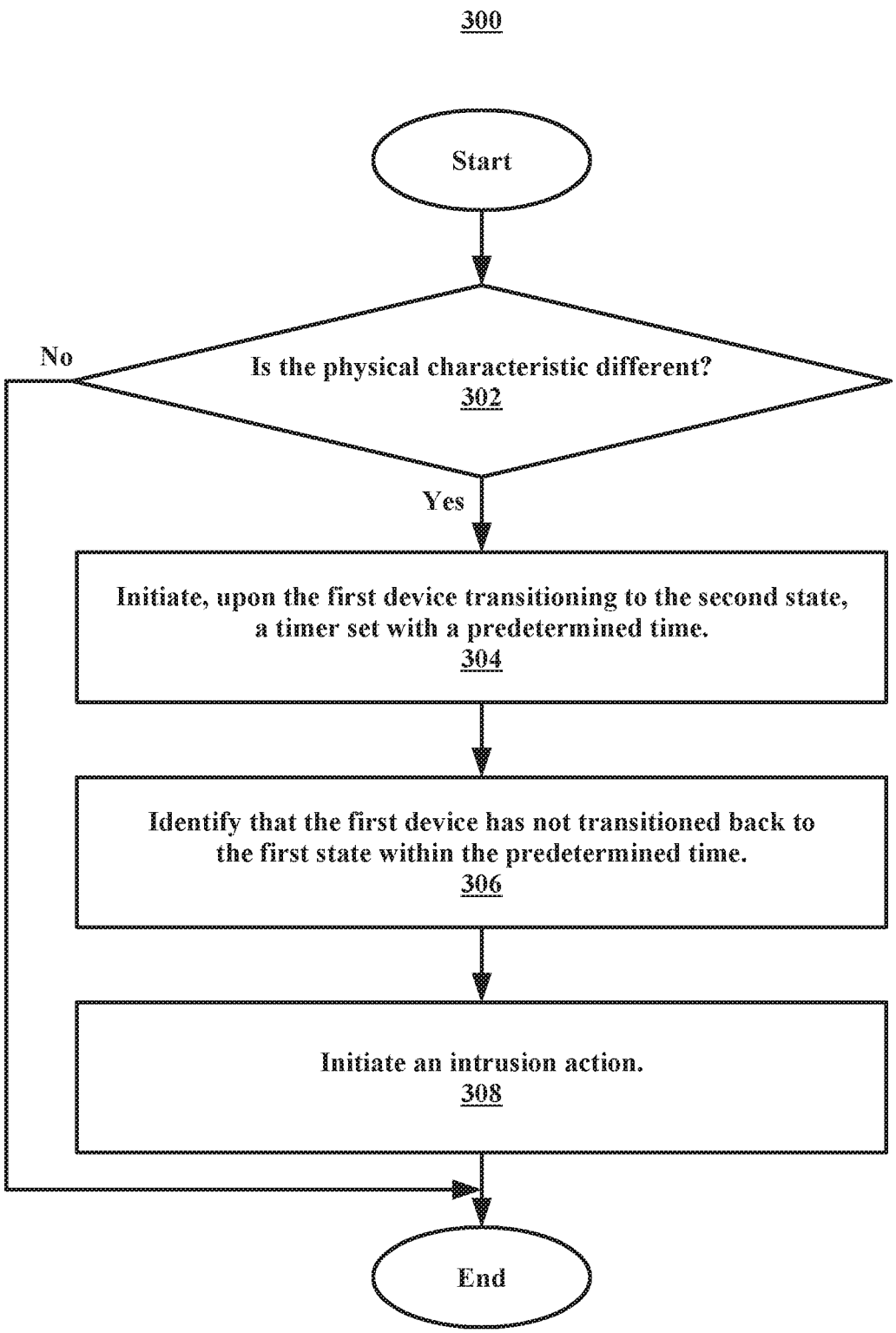
FIG. 3 illustrates a flowchart of an example method for initiating an intrusion response action, in accordance with embodiments of the present disclosure.

Referring now to FIG. 3, illustrated is a flowchart of an example method 300 for initiating an intrusion response action, in accordance with embodiments of the present disclosure. In some embodiments, the method 300 may be a continuation of the method 200 described above, in regard to FIG. 2. In some embodiments the method 200 may be performed by a first device (e.g., or a second device, or a third device, etc.). In some embodiments, the method 200 may be performed by a processor (e.g., in a first device, in a second device, etc.).

In some embodiments, the method 300 may begin at decision block 302. At decision block 302, the processor determines if the physical characteristic of the object (e.g., introduced in FIG. 2) when the first device was in the first state is different than when the first device is in the second state (e.g., if the physical characteristic of the object has changed). If, at decision block 302, it is determined that the physical characteristic of the object did not change from when the first device was in the first state to when the first device is in the second state, the method 300 ends. If, at decision block 302, it is determined that the physical characteristic of the object did change from when the first device was in the first state to when the first device is in the second state, the method 300 proceeds to operation 304.

At operation 304, the processor initiates, upon the first device transitioning to the second state, a timer set with a predetermined time. For example, the timer may be preprogrammed to initiate a 1-minute countdown sequence upon the first device transitioning from an unopened state to an opened state. In some embodiments, after operation 304, the method 300 proceeds to operation 306. At operation 306, the processor identifies that the first device has not transitioned back to the first state within the predetermined time. In some embodiments, the processor may determine if the first device has not transitioned back to the first state within the predetermined time and if the first device has transitioned back to the first state within the predetermined time, the method 300 may end.

In some embodiments, after operation 306, the method 300 may proceed to operation 308. At operation 308, the processor initiates an intrusion response action (e.g., recording the time of when the predetermined time expired, recording the location of the object upon when the predetermined time expired, recording an identity of an individual who opened the object and upon when the predetermined time expired, etc.) upon the first device not transitioning back to the first state within the predetermined time. In some embodiments, the method 300 ends after operation 308.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Figure 4:
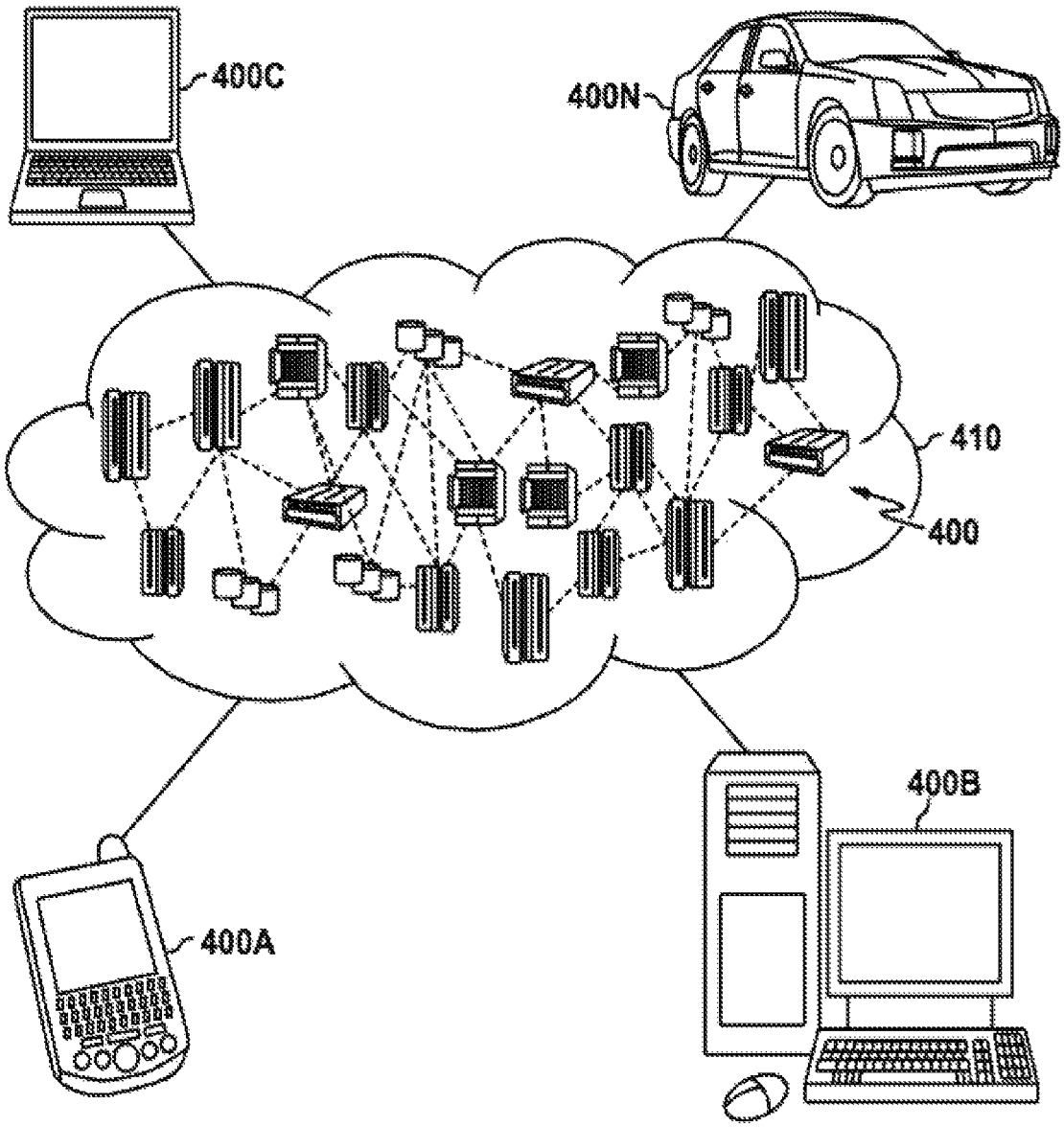
FIG. 4 depicts a cloud computing environment, in accordance with embodiments of the present disclosure.

Referring now to FIG. 4, illustrative cloud computing environment 410 is depicted. As shown, cloud computing environment 410 includes one or more cloud computing nodes 400 with which local computing devices used by cloud consumers, such as, for example, personal digital assistant (PDA) or cellular telephone 400A, desktop computer 400B, laptop computer 400C, and/or automobile computer system 400N may communicate. Nodes 400 may communicate with one another. They may be grouped (not shown) physically or virtually, in one or more networks, such as Private, Community, Public, or Hybrid clouds as described hereinabove, or a combination thereof.

This allows cloud computing environment 410 to offer infrastructure, platforms and/or software as services for which a cloud consumer does not need to maintain resources on a local computing device. It is understood that the types of computing devices 400A-N shown in FIG. 4 are intended to be illustrative only and that computing nodes 400 and cloud computing environment 410 can communicate with any type of computerized device over any type of network and/or network addressable connection (e.g., using a web browser).

Figure 5:
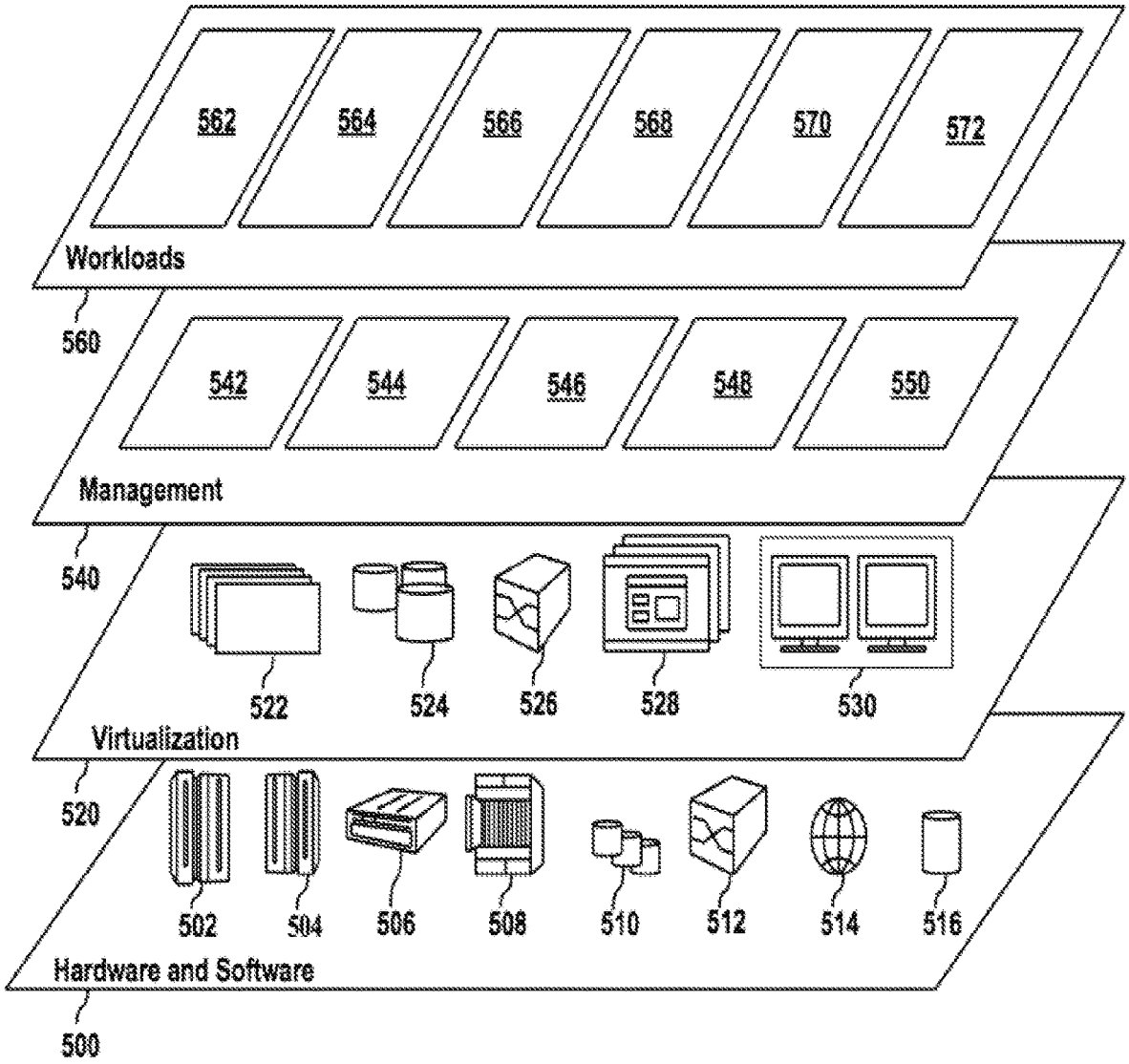
FIG. 5 depicts abstraction model layers of a cloud computing environment, in accordance with embodiments of the present disclosure.

Referring now to FIG. 5, a set of functional abstraction layers provided by cloud computing environment 410 (FIG. 4) is shown. It should be understood in advance that the components, layers, and functions shown in FIG. 5 are intended to be illustrative only and embodiments of the invention are not limited thereto. As depicted below, the following layers and corresponding functions are provided.

Hardware and software layer 500 includes hardware and software components. Examples of hardware components include: mainframes 502; RISC (Reduced Instruction Set Computer) architecture based servers 504; servers 506; blade servers 508; storage devices 510; and networks and networking components 512. In some embodiments, software components include network application server software 514 and database software 516.

Virtualization layer 520 provides an abstraction layer from which the following examples of virtual entities may be provided: virtual servers 522; virtual storage 524; virtual networks 526, including virtual private networks; virtual applications and operating systems 528; and virtual clients 530.

In one example, management layer 540 may provide the functions described below. Resource provisioning 542 provides dynamic procurement of computing resources and other resources that are utilized to perform tasks within the cloud computing environment. Metering and Pricing 544 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 546 provides access to the cloud computing environment for consumers and system administrators. Service level management 548 provides cloud computing resource allocation and management such that required service levels are met. Service Level Agreement (SLA) planning and fulfillment 550 provide pre-arrangement for, and procurement of, cloud computing resources for which a future requirement is anticipated in accordance with an SLA.

Workloads layer 560 provides examples of functionality for which the cloud computing environment may be utilized. Examples of workloads and functions which may be provided from this layer include: mapping and navigation 562; software development and lifecycle management 564; virtual classroom education delivery 566; data analytics processing 568; transaction processing 570; and intrusion response action processing 572.

Figure 6:
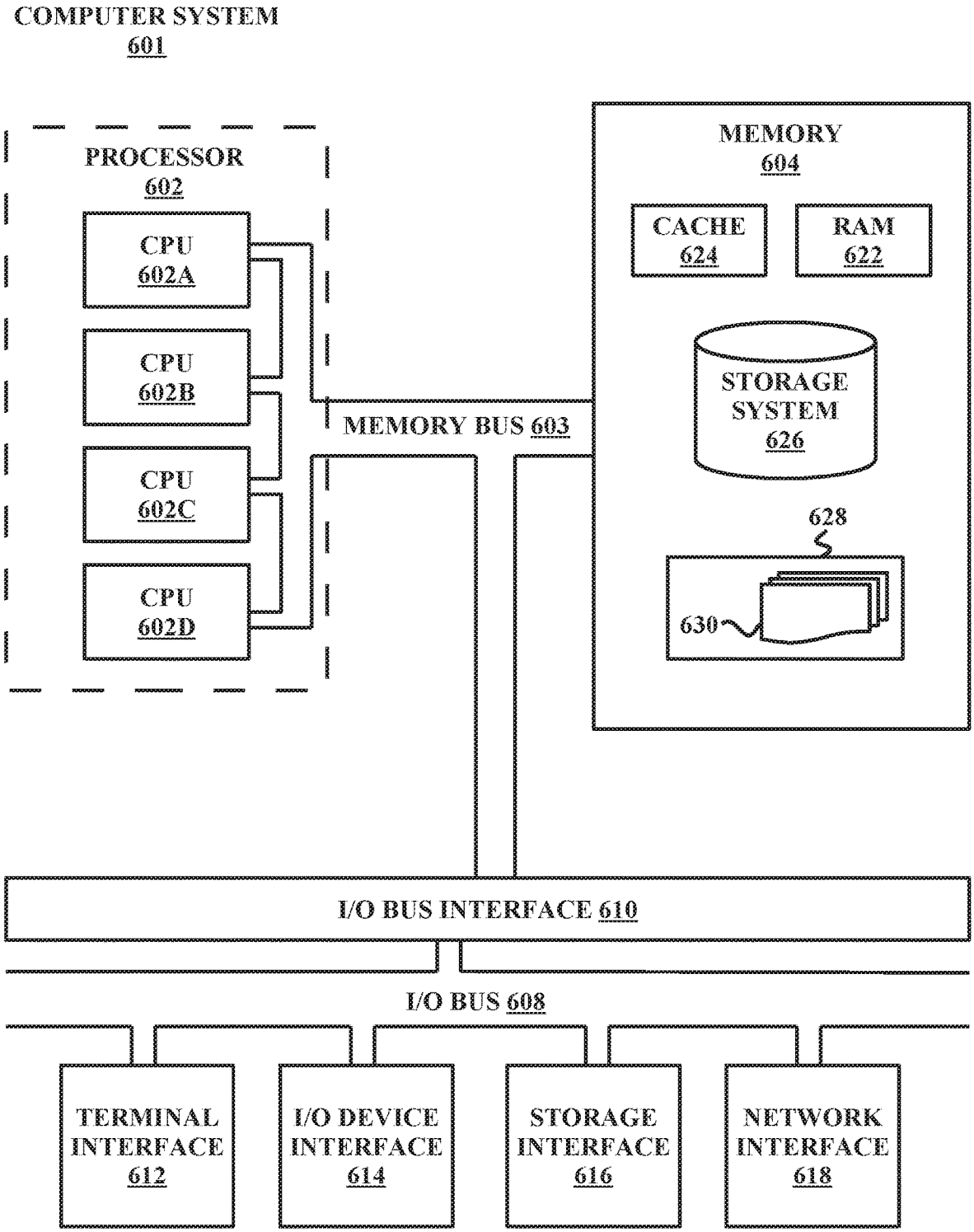
FIG. 6 illustrates a high-level block diagram of an example computer system that may be used in implementing one or more of the methods, tools, and modules, and any related functions, described herein, in accordance with embodiments of the present disclosure.

Referring now to FIG. 6, shown is a high-level block diagram of an example computer system 601 that may be used in implementing one or more of the methods, tools, and modules, and any related functions, described herein (e.g., using one or more processor circuits or computer processors of the computer), in accordance with embodiments of the present disclosure. In some embodiments, the major components of the computer system 601 may comprise one or more CPUs 602, a memory subsystem 604, a terminal interface 612, a storage interface 616, an I/O (Input/Output) device interface 614, and a network interface 618, all of which may be communicatively coupled, directly or indirectly, for inter-component communication via a memory bus 603, an I/O bus 608, and an I/O bus interface unit 610.

The computer system 601 may contain one or more general-purpose programmable central processing units (CPUs) 602A, 602B, 602C, and 602D, herein generically referred to as the CPU 602. In some embodiments, the computer system 601 may contain multiple processors typical of a relatively large system; however, in other embodiments the computer system 601 may alternatively be a single CPU system. Each CPU 602 may execute instructions stored in the memory subsystem 604 and may include one or more levels of on-board cache.

System memory 604 may include computer system readable media in the form of volatile memory, such as random access memory (RAM) 622 or cache memory 624. Computer system 601 may further include other removable/non-removable, volatile/non-volatile computer system storage media. By way of example only, storage system 626 can be provided for reading from and writing to a non-removable, non-volatile magnetic media, such as a "hard drive." Although not shown, a magnetic disk drive for reading from and writing to a removable, non-volatile magnetic disk (e.g., a "floppy disk"), or an optical disk drive for reading from or writing to a removable, non-volatile optical disc such as a CD-ROM, DVD-ROM or other optical media can be provided. In addition, memory 604 can include flash memory, e.g., a flash memory stick drive or a flash drive. Memory devices can be connected to memory bus 603 by one or more data media interfaces. The memory 604 may include at least one program product having a set (e.g., at least one) of program modules that are configured to carry out the functions of various embodiments.

One or more programs/utilities 628, each having at least one set of program modules 630 may be stored in memory 604. The programs/utilities 628 may include a hypervisor (also referred to as a virtual machine monitor), one or more operating systems, one or more application programs, other program modules, and program data. Each of the operating systems, one or more application programs, other program modules, and program data or some combination thereof, may include an implementation of a networking environment. Programs 628 and/or program modules 630 generally perform the functions or methodologies of various embodiments.

Although the memory bus 603 is shown in FIG. 6 as a single bus structure providing a direct communication path among the CPUs 602, the memory subsystem 604, and the I/O bus interface 610, the memory bus 603 may, in some embodiments, include multiple different buses or communication paths, which may be arranged in any of various forms, such as point-to-point links in hierarchical, star or web configurations, multiple hierarchical buses, parallel and redundant paths, or any other appropriate type of configuration. Furthermore, while the I/O bus interface 610 and the I/O bus 608 are shown as single respective units, the computer system 601 may, in some embodiments, contain multiple I/O bus interface units 610, multiple I/O buses 608, or both. Further, while multiple I/O interface units are shown, which separate the I/O bus 608 from various communications paths running to the various I/O devices, in other embodiments some or all of the I/O devices may be connected directly to one or more system I/O buses.

In some embodiments, the computer system 601 may be a multi-user mainframe computer system, a single-user system, or a server computer or similar device that has little or no direct user interface, but receives requests from other computer systems (clients). Further, in some embodiments, the computer system 601 may be implemented as a desktop computer, portable computer, laptop or notebook computer, tablet computer, pocket computer, telephone, smartphone, network switches or routers, or any other appropriate type of electronic device.

It is noted that FIG. 6 is intended to depict the representative major components of an exemplary computer system 601. In some embodiments, however, individual components may have greater or lesser complexity than as represented in FIG. 6, components other than or in addition to those shown in FIG. 6 may be present, and the number, type, and configuration of such components may vary.

As discussed in more detail herein, it is contemplated that some or all of the operations of some of the embodiments of methods described herein may be performed in alternative orders or may not be performed at all; furthermore, multiple operations may occur at the same time or as an internal part of a larger process.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers, and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Although the present invention has been described in terms of specific embodiments, it is anticipated that alterations and modification thereof will become apparent to the skilled in the art. Therefore, it is intended that the following claims be interpreted as covering all such alterations and modifications as fall within the true spirit and scope of the invention.

What is claimed is:

1. A computer-implemented method comprising:

identifying that a smart lock is in a first state, wherein the smart lock is paired with a light sensor that is configured to analyze a light intake of a case that includes an interior and an exterior, wherein the interior of the case houses the light sensor;

identifying, using the light sensor, the light intake of the case while the smart lock is in the first state, wherein the interior of the case is devoid of light while the smart lock is in the first state;

determining that the smart lock has transitioned to a second state, wherein the second state is associated with the interior of the case being exposed to light;

identifying, using the light sensor, the light intake of the case while the smart lock is in the second state;

comparing the light intake of the case when the smart lock was in the first state to the light intake of the case when the smart lock is in the second state, wherein the comparing identifies that the light intake in the second state is greater than in the first state; and alerting a user that the light intake of the case has increased.

2. The method of claim 1, wherein identifying the light intake of the case when the smart lock is in the second state comprises:

triggering, in response to the smart lock transitioning to the second state, the light sensor to analyze the light intake of the case.

3. The method of claim 1, further comprising:

determining, from the comparing, that the light intake of the case when the smart lock was in the first state is different than when the smart lock is in the second state; and initiating an intrusion response action, wherein the intrusion response action records environmental data associated with the case while the smart lock is in the second state.

4. The method of claim 3, wherein identifying that the light intake of the case when the smart lock was in the first state is different than when the smart lock is in the second state includes:

identifying that the light sensor transitioned from a first light intake level to a second light intake level, wherein the first light intake level and the second light intake level are quantitative values associated with the light intake.

5. The method of claim of claim 3, wherein initiating the intrusion response action further comprises:

initiating, upon the smart lock transitioning to the second state, a timer set with a predetermined time; and identifying that the smart lock has not transitioned back to the first state within the predetermined time.

6. The method of claim 1, further comprising:

identifying that the smart lock is within a predetermined range of a wearable device, the wearable device being associated with the user, and wherein the smart lock is paired with the wearable device; and disabling the smart lock and the light sensor, wherein disabling the smart lock and the light sensor includes stopping the communication between the smart lock and the light sensor and continuing communication between the smart lock and the wearable device.

7. The method of claim 6, further comprising:

identifying that the smart lock is outside of the predetermined range of the wearable device;

re-enabling the smart lock and the light sensor in response to identifying that the smart lock is outside of the predetermined range of the wearable device, wherein the smart lock is re-enabled via a first indication triggered by the wearable device, and wherein the light sensor is re-enabled via a second indication received from the smart lock.

8. A system comprising:

a memory; and a processor in communication with the memory, the processor being configured to perform operations comprising:

identifying that a smart lock is in a first state, wherein the smart lock is paired with a light sensor that is configured to analyze a light intake of a case that includes an interior and an exterior, wherein the interior of the case houses the light sensor;

identifying, using the light sensor, the light intake of the case while the smart lock is in the first state, wherein the interior of the case is devoid of light while the smart lock is in the first state;

determining that the smart lock has transitioned to a second state, wherein the second state is associated with the interior of the case being exposed to light;

identifying, using the light sensor, the light intake of the case while the smart lock is in the second state;

comparing the light intake of the case when the smart lock was in the first state to the light intake of the case when the smart lock is in the second state, wherein the comparing identifies that the light intake in the second state is greater than in the first state; and alerting a user that the light intake of the case has increased.

9. The system of claim 8, wherein identifying the light intake of the case when the smart lock is in the second state comprises:

triggering, in response to the smart lock transitioning to the second state, the light sensor to analyze the light intake of the case.

10. The system of claim 8, further comprising:

determining, from the comparing, that the light intake of the case when the smart lock was in the first state is different than when the smart lock is in the second state; and initiating an intrusion response action, wherein the intrusion response action records environmental data associated with the case while the smart lock is in the second state.

11. The system of claim 10, wherein identifying that the light intake of the case when the smart lock was in the first state is different than when the smart lock is in the second state includes:

identifying that the light sensor transitioned from a first light intake level to a second light intake level, wherein the first light intake level and the second light intake level are quantitative values associated with the light intake.

12. The system of claim of claim 10, wherein initiating the intrusion response action further comprises:

initiating, upon the smart lock transitioning to the second state, a timer set with a predetermined time; and identifying that the smart lock has not transitioned back to the first state within the predetermined time.

13. The system of claim 8, further comprising:

identifying that the smart lock is within a predetermined range of a wearable device, the wearable device being associated with the user, and wherein the smart lock is paired with the wearable device; and disabling the smart lock and the light sensor, wherein disabling the smart lock and the light sensor includes stopping the communication between the smart lock and the light sensor and continuing communication between the smart lock and the wearable device.

14. The system of claim 13, further comprising:

identifying that the smart lock is outside of the predetermined range of the wearable device;

re-enabling the smart lock and the light sensor in response to identifying that the smart lock is outside of the predetermined range of the wearable device, wherein the smart lock is re-enabled via a first indication triggered by the wearable device, and wherein the light sensor is re-enabled via a second indication received from the smart lock.

15. A computer program product comprising a computer readable storage medium having program instructions embodied therewith, the program instructions executable by a processor to cause the processor to perform a method, the method comprising:

identifying that a smart lock is in a first state, wherein the smart lock is paired with a light sensor that is configured to analyze a light intake of a case that includes an interior and an exterior, wherein the interior of the case houses the light sensor;

identifying, using the light sensor, the light intake of the case while the smart lock is in the first state, wherein the interior of the case is devoid of light while the smart lock is in the first state;

determining that the smart lock has transitioned to a second state, wherein the second state is associated with the interior of the case being exposed to light;

identifying, using the light sensor, the light intake of the case while the smart lock is in the second state;

comparing the light intake of the case when the smart lock was in the first state to the light intake of the case when the smart lock is in the second state, wherein the comparing identifies that the light intake in the second state is greater than in the first state; and alerting a user that the light intake of the case has increased.

16. The computer program product of claim 15, wherein identifying the light intake of the case when the smart lock is in the second state comprises:

triggering, in response to the smart lock transitioning to the second state, the light sensor to analyze the light intake of the case.

17. The computer program product of claim 15, further comprising:

determining, from the comparing, that the light intake of the case when the smart lock was in the first state is different than when the smart lock is in the second state; and initiating an intrusion response action, wherein the intrusion response action records environmental data associated with the case while the smart lock is in the second state.

18. The computer program product of claim 17, wherein identifying that the light intake of the case when the smart lock was in the first state is different than when the smart lock is in the second state includes:

identifying that the light sensor transitioned from a first light intake level to a second light intake level, wherein the first light intake level and the second light intake level are quantitative values associated with the light intake.

19. The computer program product of claim of claim 17, wherein initiating the intrusion response action further comprises:

initiating, upon the smart lock transitioning to the second state, a timer set with a predetermined time; and identifying that the smart lock has not transitioned back to the first state within the predetermined time.

20. The computer program product of claim 15, further comprising:

identifying that the smart lock is within a predetermined range of a wearable device, the wearable device being associated with the user, and wherein the smart lock is paired with the wearable device; and disabling the smart lock and the light sensor, wherein disabling the smart lock and the light sensor includes stopping the communication between the smart lock and the light sensor and continuing communication between the smart lock and the wearable device, identifying that the smart lock is outside of the predetermined range of the wearable device;

re-enabling the smart lock and the light sensor in response to identifying that the smart lock is outside of the predetermined range of the wearable device, wherein the smart lock is re-enabled via a first indication triggered by the wearable device, and wherein the light sensor is re-enabled via a second indication received from the smart lock.

* * * * *